US005224407A

United States Patent [19]

Koch et al.

[11] Patent Number: 5,224,407

[45] Date of Patent: Jul. 6, 1993

[54] COLD MEAT SLICING MACHINE

[75] Inventors: Klaus Koch, Geislingen; Michael Fuchs, Esslingen; Viktor Fecker, Hechingen, all of Fed. Rep. of Germany

[73] Assignee: Bizerba-Werke Wilhelm Kraut GmbH & Co. KG, Balingen, Fed. Rep. of Germany

[21] Appl. No.: 857,621

[22] Filed: Mar. 25, 1992

[30] Foreign Application Priority Data

Mar. 30, 1991 [DE] Fed. Rep. of Germany ..... 4110526

[51] Int. Cl.[5] ..... B26D 5/22; B26D 1/18

[52] U.S. Cl. ..... 83/468.7; 83/42; 83/718; 83/727; 83/728

[58] Field of Search ..... 83/718, 42, 468.7, 263, 83/268, 727, 728

[56] References Cited

U.S. PATENT DOCUMENTS

| | | | |
|---|---|---|---|
| 1,356,284 | 10/1920 | Hopkinson | 83/718 |
| 2,167,095 | 7/1939 | Van Berkel | 83/718 |
| 3,613,754 | 10/1971 | Hartley | 83/718 |
| 3,713,470 | 1/1973 | Müller et al. | 83/718 |

*Primary Examiner*—Frank T. Yost
*Assistant Examiner*—Kenneth E. Peterson
*Attorney, Agent, or Firm*—Shenier & O'Connor

[57] ABSTRACT

A cold meat slicing machine having a circular cutter blade, an adjustable stop plate, a carriage for the product to be cut preferably driven by a motor, an automatic feed for the product to be cut, a first adjustment for adjusting the stop plate in response to a desired thickness of cut (slice thickness) and a second adjustment coupled with the first adjustment for adjusting the feed increment of the product to be cut on the carriage in response to a desired thickness of cut (slice thickness). The first adjustment for the stop plate comprises a first guideway and the adjustment for the feeding of the product to be cut comprises a second guideway rotationally fixed relative to the first guideway.

10 Claims, 4 Drawing Sheets

COLD MEAT SLICING MACHINE

The invention relates to a cold meat slicing machine as defined in the preamble to patent claim 1.

In slicing machines for cold meats or cuts of this type, it is appropriately intended that a preselectable slice thickness can be cut. In this respect, when the product to be cut is fed automatically, it is automatically moved forward gradually towards the cutter blade and each time by the preselected slice thickness (thickness of cut) and, at the same time, a stop plate provided as protective plate leaves the desired cutting gap free. This is intended to be set via a common control knob and this setting made visible on a scale.

In order to fulfill the specified requirements, it is known in these cold meat slicing machines having such an automatic feed means, for a holder for the product to be cut, which is displaceable transversely on the carriage for the product to be cut, to be held in engagement with a feed spindle via a disconnectable apron and for the apron and, with it, the holder to be transported gradually towards the circular cutter blade by rotating this spindle. The feed spindle is provided at one end with a gear wheel which engages with a gear rack arranged transversely to the spindle axis and runs along this due to linear longitudinal movement of the gear rack, hereby causing the spindle to rotate.

The gear wheel is coupled to the feed spindle via a freewheel which allows the spindle to be taken along during rotation only in the feed direction and in the opposite direction leaves the gear wheel to run through freely.

The return movement of the gear rack takes place via a spring, the freewheel hereby preventing any taking along of the feed spindle during rotation.

The forward movement of the gear rack is brought about in such a manner that when the carriage for the product to be cut is moved backwards (manually or by a motor) the gear rack runs onto a feed lever located in a position defined by the setting for the thickness of cut and is thereby displaced contrary to the spring force in its guide bearings. This displacement causes the gear wheel to rotate and, with it, the feed spindle due to the blocking of the freewheel and this causes feeding of the product to be cut which is held by the holder.

The abutting position of the guide rack, which is determined by the setting of the feed lever, determines the feed path.

The positioning of the feed lever is ensured by a complicated mechanism. Furthermore, it is known to set the thickness of cut via a control knob provided with a scale. The control knob is connected to a threaded spindle which bears a nut. During its longitudinal movement, the nut actuates at the same time a lever system for the stop plate and a further lever system for the feed lever. Both lever systems operate synchronously in accordance with their associated predetermined paths and generally consist of a plurality of lever and coupling elements as well as bearing and moving joints.

In simple slicing machines without a motor-driven carriage and without automatic feeding of the product to be cut, it is also known to adjust the protective plate provided in this case as stop plate via a spirally formed cam disc in its longitudinal guide means. An adjustment path of the stop plate which is overproportional to the angle of rotation of the control knob can also be achieved so that in the lower range a greater angle of rotation is installed for a small displacement path and vice versa. This has the advantage that thickness of cut ranges for, on the whole, thin slices can be adjusted more precisely.

A cold meat slicing machine, in which a single guideway is used for adjusting the thickness of cut, is known from DE-A1-33 04 610.

The object of the invention is to simplify the mechanism for adjusting the thickness of cut (slice thickness) in a generic slicing machine, wherein the possibility of an overproportional feeding of the product to be cut is to be retained in simple slicing machines not having a motor-driven carriage.

The advantages which can be achieved by the invention are to be seen, in particular, in the fact that numerous angle levers, coupling members, bearing points and joints are dispensed with and in a feeding means for cold meat slicing machines having hand-operated carriages the overproportional pitch of a spiral guideway can be complemented by simple components for the means for feeding the product to be cut.

The following description of preferred embodiments of the invention serves to explain the invention in greater detail in conjunction with the attached drawings. In these drawings.

Figure 3:
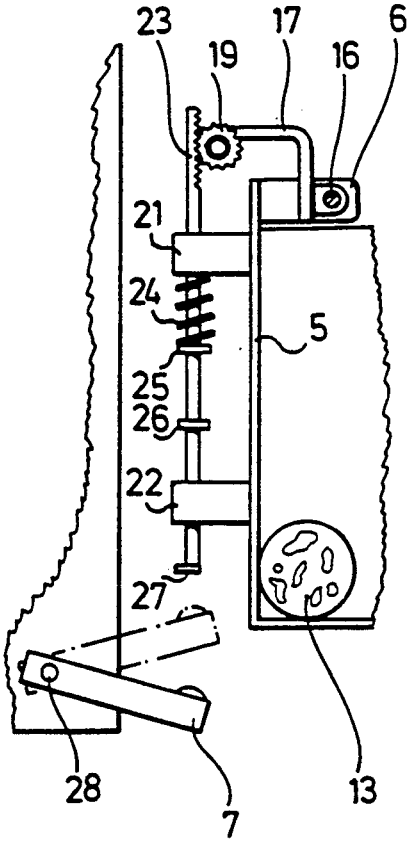
FIG. 3 is a partial side view of the carriage from FIG. 2.
Figure 3A:
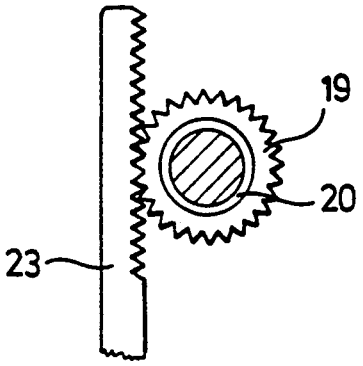
Figure 4:
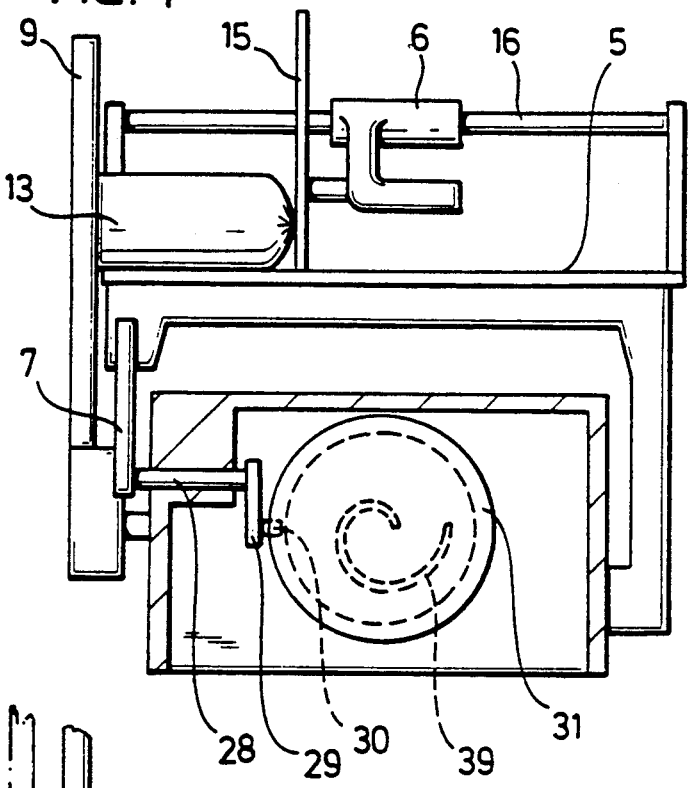
Figure 5:
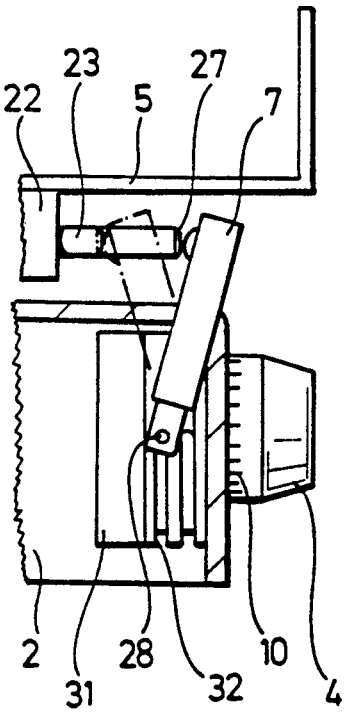

FIG. 3*a* is an enlarged section from FIG. 3;

FIG. 4 is a partial side view of a machine housing with an adjusting means;

FIG. 5 is a side view of the adjusting means from FIG. 4 and

Figure 6:
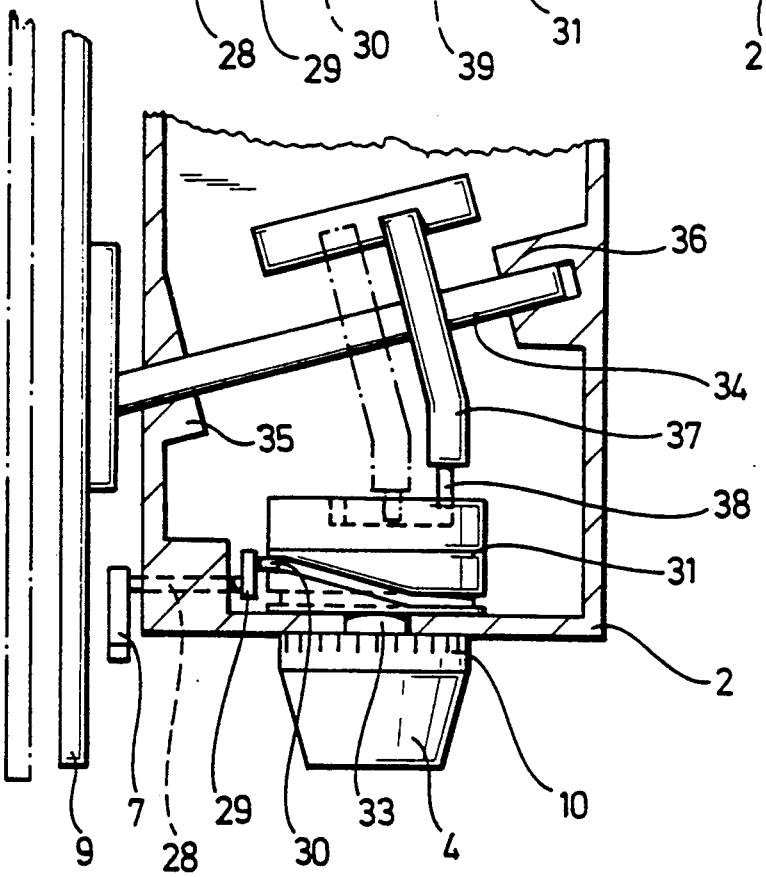

FIG. 6 is a plan view of the adjusting means from FIGS. 4 and 5.

Figure 7:
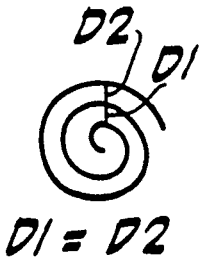
Figure 8:
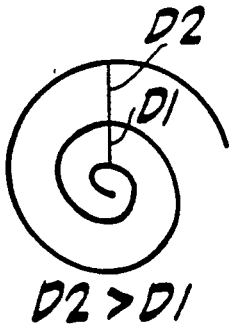
Figure 9:
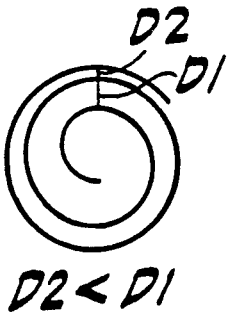
Figure 10:
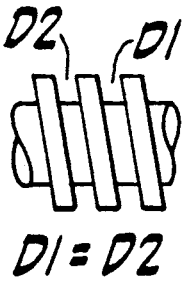
Figure 11:
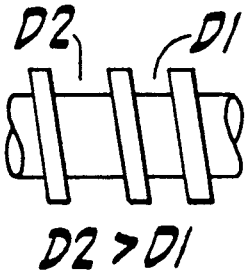
Figure 12:
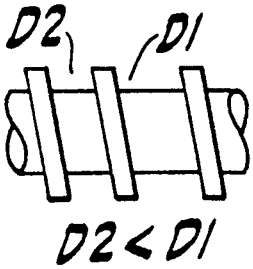
Figure 13:
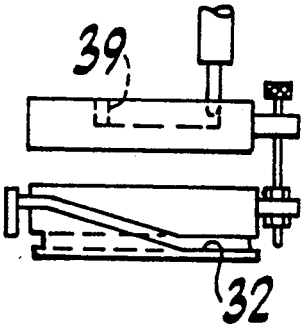

FIG. 7 shows the first guideway with a constant pitch;

FIG. 8 shows the first guideway with a progressive pitch;

FIG. 9 shows the first guideway with a degressive pitch;

FIG. 10 shows the second guideway with a constant pitch;

FIG. 11 shows the second guideway with a progressive pitch;

FIG. 12 shows the second guideway with a degressive pitch;

FIG. 13 shows the two guideways mounted on separate members.

Figure 1:
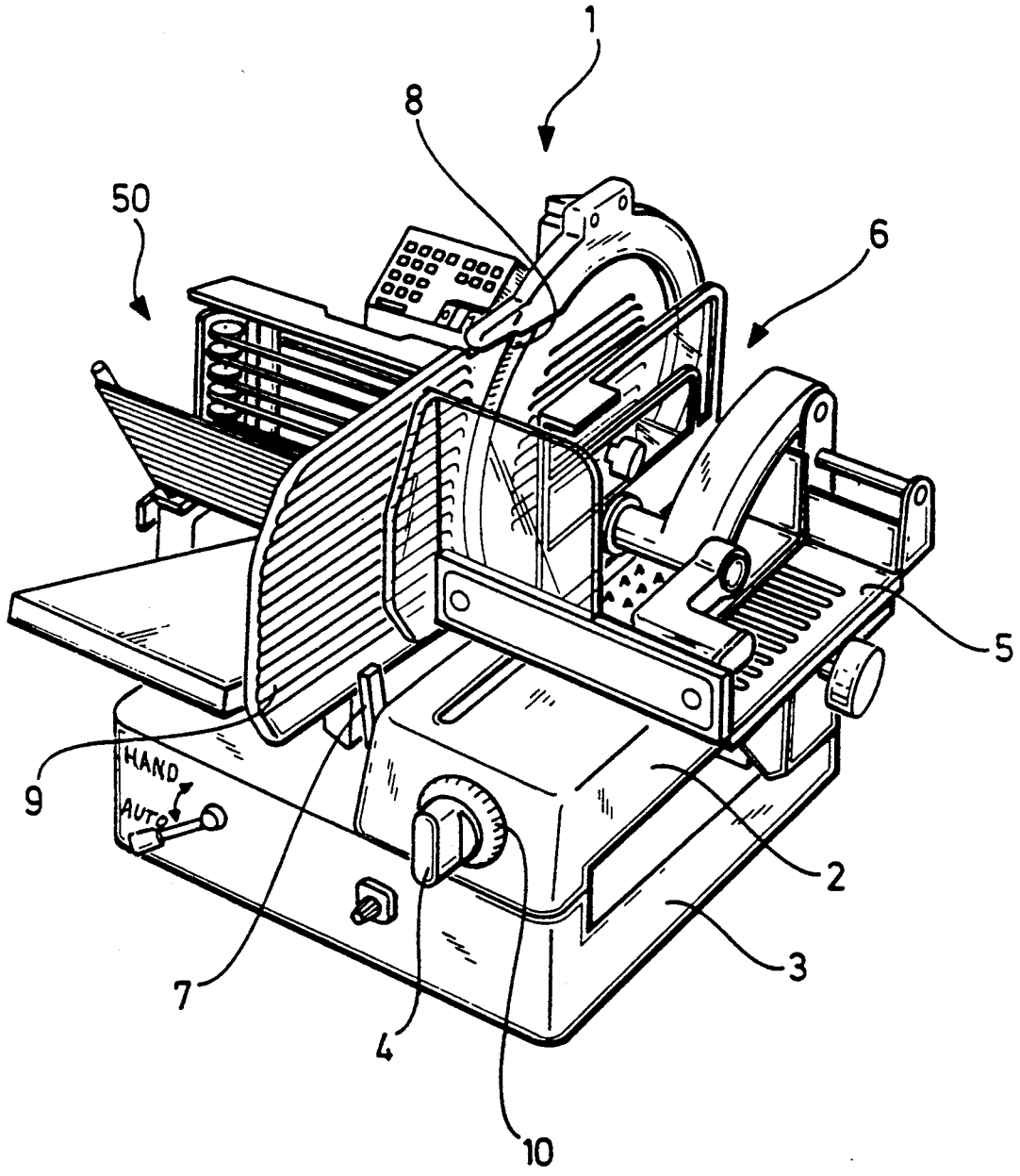
FIG. 1 is a diagrammatic illustration of a cold meat slicing machine.

The cold meat slicing machine 1 schematically illustrated in FIG. 1, which has the possibility of selecting manual or automatic operation, essentially consists of the following assemblies or components:

a machine housing 2,
a drive housing 3,
a control knob 4,
a carriage 5 for the product to be cut,
a holder 6 for the product to be cut having a clamping device and a feeding means for the product to be cut,
a feed lever 7,
a rotatingly driven circular cutter blade 8,
a stop or protection plate 9 and
a scale 10 for the control knob 4.

During manual operation, the carriage 5 with the product to be cut (not illustrated in FIG. 1) is displaced back and forth by hand and the product on the carriage 5 guided towards the circular cutter blade 8 and the stop plate 9. During automatic operation, the carriage 5 is driven by a motor and the product to be cut automatically moved forwards towards the stop plate 9 in steps corresponding to the thickness of cut set.

Figure 2:
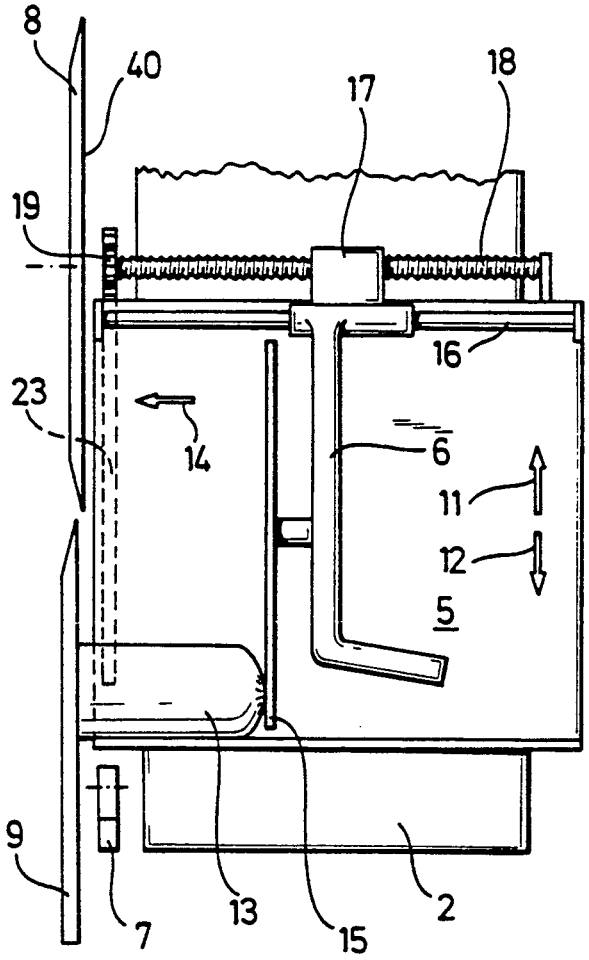
FIG. 2 is a schematic plan view of a carriage for the product to be cut in the cold meat slicing machine of FIG. 1.

The carriage 5 is connected with the machine housing 2 via a longitudinal guide means with end stops which is not illustrated and is moved back and forth by hand or by a motor in the directions of arrows 11 and 12 (FIG. 2). A product to be cut 13 is moved in the direction of arrow 14 towards the circular cutter blade 8 and the stop plate 9, in the region of the forward stop of the carriage and hereby making complete use of the displacement path in the direction of arrow 12, and is therefore ready for a new cut. During motor-driven operation of the carriage 5 and automatic feeding of the product to be cut, the product 13 is moved in the direction of arrow 14 towards the stop plate 9 by the holder 6 and a residue holding plate 15 connected therewith.

The holder 6 is guided on the carriage 5 for transverse displacement in a guide means 16 and engages with a feed spindle 18 via a disconnectable apron 17. When the feed spindle 18 rotates, the apron 17 is displaced according to the thread pitch of the spindle 18 in the direction of arrow 14 or opposite thereto, depending on the direction of rotation.

The feed spindle 18 is rotatably mounted on the carriage 5 and bears on its side facing the cutter blade 8 a gear wheel 19 which is coupled to the spindle 18 via a freewheel 20 (FIG. 3*a*) in the known manner.

The gear wheel 19 engages with a gear rack 23 arranged on the carriage 5 transversely to the axial direction of the feed spindle 18 and this gear rack is displaceable through guide means 21, 22 on the carriage 5 (FIG. 5).

When the gear rack 23 is displaced in its guide means 21 and 22 relative to the carriage 5 and optionally in the direction of arrow 11 or arrow 12, the gear wheel 19 is caused to rotate about its axis which also forms the axis of the feed spindle 18. The freewheel 20 is arranged such that when the gear rack 23 is displaced in the direction of the arrow 11, the feed spindle 18 is rotated in such a manner that this causes the holder 6, which is in engagement with the feed spindle 18 via its apron 17, to be displaced in the direction of the arrow 14 towards the cutter blade 8 and the stop plate 9. When the gear rack 23 is displaced in the direction of the arrow 12, the gear wheel 19 runs freely on its axis and only a slight force is required for this movement so that this return movement can be brought about by a spring 24 arranged accordingly.

The distance the product 13 to be cut is displaced in the direction of the arrow 14 on the carriage 5 is directly proportional to the distance the gear rack 23 is displaced in the direction of the arrow 11. For this reason, the gear rack 23 is equipped with adjustable stops 25 and 26 which enable the gear rack 23 to be adjusted exactly in relation to the carriage 5 for the product to be cut and to the gear wheel 19, whereby the gear rack 23 comes to rest on the guide means 22 with the stop 26 due to the spring 24.

When the carriage 5 for the product to be cut is withdrawn, the gear rack 23, and an abutting surface 27 provided thereon, is displaced by a predetermined distance or rather held in place from a predetermined point onwards when the carriage 5 is withdrawn. This means that it is displaced through a distance which is exactly defined in relation to the carriage 5 for the product to be cut. During this displacement, the product 13 to be cut is, as described above, displaced proportionally to the stroke of the gear rack 23 in the direction of the arrow 14 towards the stop plate 19.

The gear rack 23 is temporarily held in place in response to the desired gear rack stroke by the feed lever 7, which is mounted in the machine housing 2 on a shaft 28, forms an adjusting means together with the control knob 4 and is at an exactly defined distance from the forward point of reversal of the carriage 5 for the product to be cut. This distance is adjustable by pivoting the feed lever 7 about its shaft 28 and corresponds, as illustrated in the additional Figures and described in the following, to the setting of the control knob 4 on the scale 10.

FIGS. 4 to 6 show the operating principle of the positioning association of the feed lever 7 with the stop plate 9. The feed lever 7 is non-rotatably connected via its shaft 28 in the interior of the machine housing 2 with a lever arm 29, on which a follower pin 30 is arranged. The follower pin 30 engages in a guideway 32, which is arranged at the circumference of a cylindrical cam disc 31 and extends in a helical shape, and is pivoted about the axis of the shaft 28, taking along the lever arm 29 and the feed lever 7, by rotation of the cam disc 31 which takes place via the control knob 4 with scale 10. The cam disc 31 and the control knob 4 are mounted via a shaft 33 so as to be securely connected and rotatable on the machine housing 3.

The stop plate 9 is firmly connected to a guide rod 34 and mounted in the machine housing for displacement in guide means 35 and 36. A clamping lever 37 is firmly clamped on the guide bar 34 in the known manner due to friction locking and also forms an adjusting means together with the control knob 4.

The clamping lever 37 serves, on the one hand, to secure the guide bar 34 against rotation and bears, on the other hand, a pin 38 which engages in a spiral guideway 39 arranged on the end face of the cam disc 31 so that the clamping lever 37, when the cam disc 31 is rotated, is displaced in a horizontal direction, axially taking along the guide bar 34 and, with it, the stop plate 9.

The reciprocal leverage ratios of the lever arm 29, the lever 7 and the kinematically following elements on the carriage 5 for the product to be cut as well as the pitches of the guideways 32 and 39 are designed such that when the cam disc 31 is rotated by the control knob 4 a proportional movement between the stop plate 9 and the feed lever 7 is achieved. The change in position of the feed lever 7 sees to it that when the carriage 5 is travelling back in the direction of the arrow 12 as far as the point of reversal the holder 6 for the product to be cut is displaced towards the cutter blade 8 (arrow 14) by the same distance as the stop plate by the clamping lever 37 with pin 38 beyond the cutting plane 40 of the cutter blade 8 in the direction of the arrow 14.

The helical guideway 32 on the cylindrical casing of the cam disc 31 and the spiral guideway 39 formed on its end face can, in response to the angle of rotation of the control knob 4, have constant pitches or pitches varying progressively or degressively. The pitches can also be altered in accordance with a curve of a higher order and the courses of the two guideways are designed to be synchronous with one another or possibly proportional. This means that it is, for example, possible to obtain a large angle of rotation per displacement path of feed lever 7 or stop plate 9 in the range of small slice thicknesses and a small angle of rotation in the range of large slice thicknesses. The necessary angle of rotation of the control knob 4 is therefore greater for the same feed path when the preselection for cutting thinner slices is intended to be made in a finer gradation.

This advantage cannot be achieved in the known automatic cold meat slicing machines having feeding means for the product to be cut.

For reasons of construction it can also be favourable to limit the feed path of the automatic feeding of the product to be cut in cold meat slicing machines for manual and/or automatic operation since a following slice stacking device 50, which is known per se (FIG. 1), can only receive and stack a limited slice thickness. For manual operation, it is possible to remove the stacking device 50 and hereby enable thicker slices to be cut.

This requirement is fulfilled in an additional embodiment of the invention in that the distance travelled for feeding the product to be cut is limited by the associated guideway 32 and this reduced feed path follows the same course as the corresponding region of the guideway 39 and that from a constructionally predetermined limit onwards the stop plate 9 can be adjusted further in accordance with its associated guideway 39 whereas the feeding means for the product to be cut is not moved further.

The guideways 32 and 39 can also, in another embodiment of the invention, each be arranged separately on members which are adjustable relative to one another, wherein these members can be rigidly connected with one another by connecting elements.

We claim:

1. Cold meat slicing machine comprising a circular cutter blade, an adjustable stop plate, a carriage for the product to be cut, an automatic feeding means for the product to be cut, a first adjusting means for adjusting the stop plate in response to a desired thickness of cut (slice thickness) and a second adjusting means coupled with the first adjusting means for adjusting a feed increment of the product to be cut on the carriage in response to a desired thickness of cut (slice thickness), characterized in that the first adjusting means (4, 37) for the stop plate (9) comprises a first guideway (39) and the second adjusting means (4,7) for the feeding of the product to be cut comprises a second guideway (32) rotationally fixed relative to the first guideway and in that the first guideway (39) is formed spirally at the end face of a cylindrical cam disc (31) and the second guideway (32) helically at the casing of the cylindrical cam disc (31).

2. Slicing machine as defined in claim 1, characterized in that the feed increment of the holder (6) for the product to be cut is limited by the associated second guideway (32), that this reduced feed increment follows the same course as the corresponding area of the first guideway (39), and that from a constructionally predetermined limit onwards the stop plate (9) is able to be adjusted further in accordance with the first guideway (39) associated therewith whereas the feed path of the holder (6) is not able to be altered further.

3. Slicing machine as defined in claim 1, characterized in that the guideways (32, 39) are coordinated with one another such that in conjunction with following mechanical transmissions (29, 30; 31, 34) the displacement path of the feeding means for the product to be cut and the displacement path of the stop plate (9) are the same size.

4. Slicing machine as defined in claim 1, characterized in that the guideways (32, 39) have a constant pitch and upon rotation of a control knob (4) give rise to a uniform displacement path per unit of angle.

5. Slicing machine as defined in claim 1, characterized in that the guideways (32, 39) have a progressive pitch and upon rotation of a control knob (4) trigger a varying displacement path per unit of angle, wherein the angles of rotation of the control knob (4) associated with adjustments corresponding to smaller slice thicknesses are preferably greater than in the range of larger slice thicknesses.

6. Slicing machine as defined in claim 1, characterized in that the guideways (32, 39) have a degressive pitch.

7. Slicing machine as defined in claim 1, characterized in that the pitches of the guideways (32, 39) vary according to a mathematical curve of a higher order, preferably over the course of the entire guideways.

8. Slicing machine as defined in claim 1, characterized in that a follower pin (30) provided at a lever arm (29) engages in the second guideway (32), and when the cam disc (31) is rotated pivots a feed lever rigidly arranged on a shaft (23) together with the lever arm (29), said feed lever for its part forming a point of abutment for a gear rack (23) displaceable relative to the carriage (5) for the product to be cut, and the gear rack (23) triggers the displacement of the holder (6) for the product to be cut.

9. Slicing machine as defined in claim 8, characterized in that the leverage ratios predetermined by the feed lever (7), the shaft (28), the lever arm (29) and the follower pin (30) are such that they supplement the automatic transmissions between the gear rack (23) and a gear wheel (19) engaging in the gear rack and driving a feed spindle (18) and therefore adapt the feed increment of the holder (6) to the displacement path of the stop plate (9).

10. Slicing machine as defined in claim 1, characterized in that the guideways (32, 39) are each arranged separately on members adjustable relative to one another, and these member are rigidly connectable with one another by connecting elements.

* * * * *

UNITED STATES PATENT AND TRADEMARK OFFICE

CERTIFICATE OF CORRECTION

PATENT NO. : 5,224,407

DATED : July 6, 1993

INVENTOR(S) : Klaus Koch, Michael Fuchs. Viktor Fecker

It is certified that error appears in the above-identified patent and that said Letters Patent is hereby corrected as shown below:

Column 6, line 37, after "shaft" delete (23), insert -- (28) --.

Signed and Sealed this

Eighteenth Day of January, 1994

*Attest:*

Bruce Lehman

BRUCE LEHMAN

*Attesting Officer*

*Commissioner of Patents and Trademarks*